US008826493B2

(12) United States Patent
Stegens

(10) Patent No.: US 8,826,493 B2
(45) Date of Patent: Sep. 9, 2014

(54) VACUUM CLEANER BRUSHROLL

(75) Inventor: Eric A. Stegens, Olmsted Falls, OH (US)

(73) Assignee: The Scott-Fetzer Company, Cleveland, OH (US)

( * ) Notice: Subject to any disclaimer, the term of this patent is extended or adjusted under 35 U.S.C. 154(b) by 734 days.

(21) Appl. No.: 13/027,416

(22) Filed: Feb. 15, 2011

(65) Prior Publication Data

US 2012/0204367 A1 Aug. 16, 2012

(51) Int. Cl.

| | |
|---|---|
| ***A47L 5/26*** | (2006.01) |
| ***A47L 9/04*** | (2006.01) |
| ***A46B 15/00*** | (2006.01) |
| ***A46B 13/00*** | (2006.01) |

(52) U.S. Cl.

CPC ..... *A47L 9/0427* (2013.01); *A46B 15/0053* (2013.01); *A46B 13/001* (2013.01)

USPC ..... 15/392; 15/23; 15/50.3; 15/52.1

(58) Field of Classification Search

USPC ..... 15/389, 392, 23–27, 50.3, 52.1

IPC ..... A47L 5/26

See application file for complete search history.

(56) References Cited

U.S. PATENT DOCUMENTS

| | | | | |
|---|---|---|---|---|
| 1,681,453 | A | 8/1928 | Wright | |
| 3,225,374 | A | 12/1965 | Daley et al. | |
| 5,193,243 | A | 3/1993 | Stegens | |
| 5,272,785 | A | 12/1993 | Stegens | |
| 5,373,603 | A | 12/1994 | Stegens | |
| 5,435,038 | A | 7/1995 | Sauers | |
| 5,465,451 | A | 11/1995 | Stegens | |
| 5,598,600 | A | 2/1997 | Stegens | |
| 5,781,962 | A * | 7/1998 | Fiegel et al. | 15/392 |
| 6,003,198 | A | 12/1999 | Stegens | |
| 6,324,714 | B1 * | 12/2001 | Walz et al. | 15/52.1 |
| 6,591,440 | B2 | 7/2003 | Stegens et al. | |
| 6,591,441 | B2 | 7/2003 | Stegens et al. | |
| 6,745,426 | B1 * | 6/2004 | Knowles | 15/104.04 |
| 2004/0045125 | A1 | 3/2004 | Park et al. | |

* cited by examiner

*Primary Examiner* — David Redding

(74) *Attorney, Agent, or Firm* — Pearne & Gordon LLP

(57) ABSTRACT

A shaft driven vacuum cleaner brushroll that can be mounted in the nozzle of the vacuum cleaner and directly connected to a shaft of the cleaner's motor drive shaft system. The brushroll features a two-piece drive assembly that simplifies its manufacture and can be engaged on a wood spindle to effectively transmit torque from the vacuum cleaner drive to the brushroll.

3 Claims, 2 Drawing Sheets

VACUUM CLEANER BRUSHROLL

FIELD OF THE INVENTION

The present invention relates generally to vacuum cleaners, and, more specifically, to a shaft driven vacuum cleaner brushroll that can be mounted in the nozzle of the cleaner in direct connection to its motor drive.

BACKGROUND OF THE INVENTION

Prior art vacuum cleaner brushrolls typically have bearing end assemblies that support the brushrolls for rotation in the vacuum cleaner nozzle. The brushrolls are driven by pulley belts tied to the motor drive systems of the cleaners. When a pulley driven brushroll is replaced, it is necessary to disengage the belt, replace the old brushroll with a new one, and re-engage the pulley belt in the proper place. The pulley belts themselves require periodic replacement.

In an effort to avoid the problems and disadvantages of pulley drive arrangements, a construction has been devised for directly connecting the brushroll to the motor drive shaft system of the vacuum cleaner. A known shaft driven brushroll comprises a hollow plastic spindle having internal, integral ribs, and a one-piece, injection-molded drive member that coacts with the ribs of the spindle to transmit torque from the driver shaft system to the spindle. Since the described arrangement requires a spindle having internal ribs, the spindle must be a plastic member that can be extruded or injection molded. Wood spindles, which have many advantages, cannot be used. Another disadvantage is that one-piece plastic drive member that transmits torque from the vacuum cleaner drive has a complex configuration that must be injection molded using an intricate mold.

SUMMARY OF THE INVENTION

An object of the invention is to provide an improved shaft driven vacuum cleaner brushroll that can be mounted in the nozzle of the vacuum cleaner and directly connected to a shaft of the motor driven shaft system of the vacuum cleaner. The term motor drive shaft system means one or more shafts driven by the motor. The invention features a two-piece spindle drive assembly at one end of the spindle. The drive assembly consists of a ferrule secured to the end of the spindle and a drive pin inserted through the ferrule into the spindle end. The ferrule and drive pin are assembled together as a unit to effectively transmit torque from the motor drive shaft system of the vacuum cleaner to the brushroll.

In the disclosed embodiment, the ferrule member has a skirt that is fitted around the brushroll spindle and an inner neck that seats in a recess formed in the end of the spindle. The end of the spindle is captured between the ferrule skirt and its neck portion. The drive pin has a shaft section inserted through the ferrule into the spindle and a head section having a quick connect-disconnect permitting easy attachment of the brushroll to a shaft of the motor drive shaft system of the cleaner. Cooperating locking surfaces on the ferrule neck and drive pin securely lock the two parts together so that they function as a unit.

The above-described construction has a number of features and advantages. The ferrule and drive pin can be made separately and then assembled simply by inserting the drive pin into the ferrule. The ferrule is locked on the end of the spindle by capturing the spindle end between the ferrule skirt and neck, and by extending the end bristles of the brushroll through the ferrule skirt. Another important advantage is that the ferrule and drive pin assembly can be used in conjunction with a wood spindle. As described above, the prior art shaft driven brushroll can be used only in conjunction with a plastic spindle having internally formed ribs.

DESCRIPTION OF PREFERRED EMBODIMENTS

Figure 1:
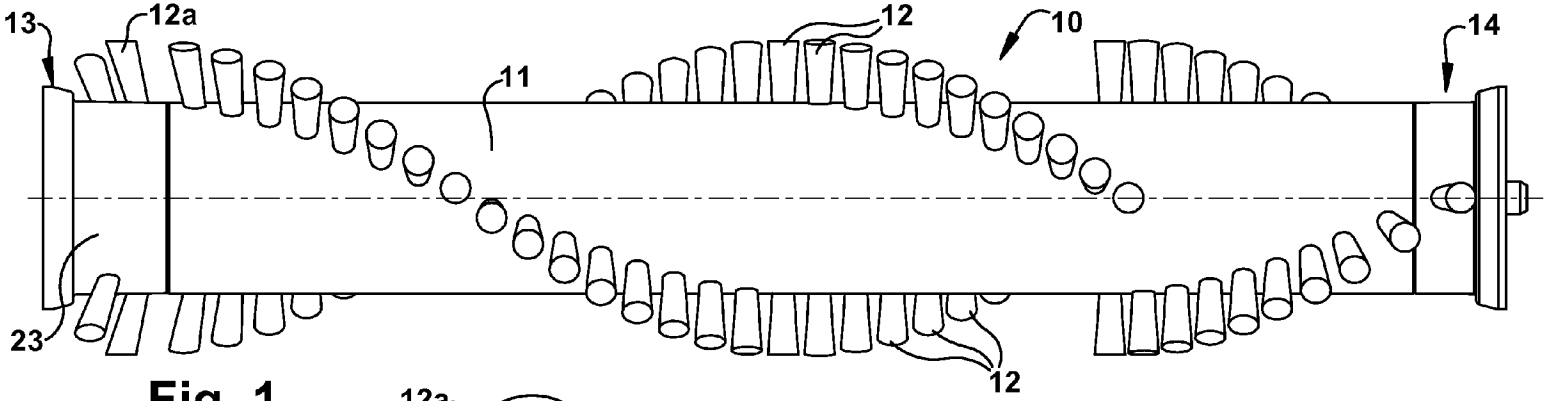
FIG. 1 is an elevational view of a brushroll embodying the invention.

Referring to the drawings, the illustrated brushroll is generally indicated by reference number 10. The brushroll consists of a wood spindle 11 having helical rows of bristle tufts 12, a drive assembly 13 that embodies the invention at one end of the brushroll, and an end assembly 14 at the other end of the brushroll. The end assembly 14, which is not part of the invention, rotatably supports the brushroll in the nozzle (not shown) of a vacuum cleaner. As disclosed in U.S. Pat. Nos. 5,272,785 and 6,591,440, the end assembly 14 may include a stub shaft extending from the end of the spindle and a bearing having its inner race press fitted on the stub shaft and its outer race fixed in an end cap that mounts in the vacuum cleaner nozzle.

Figure 2:
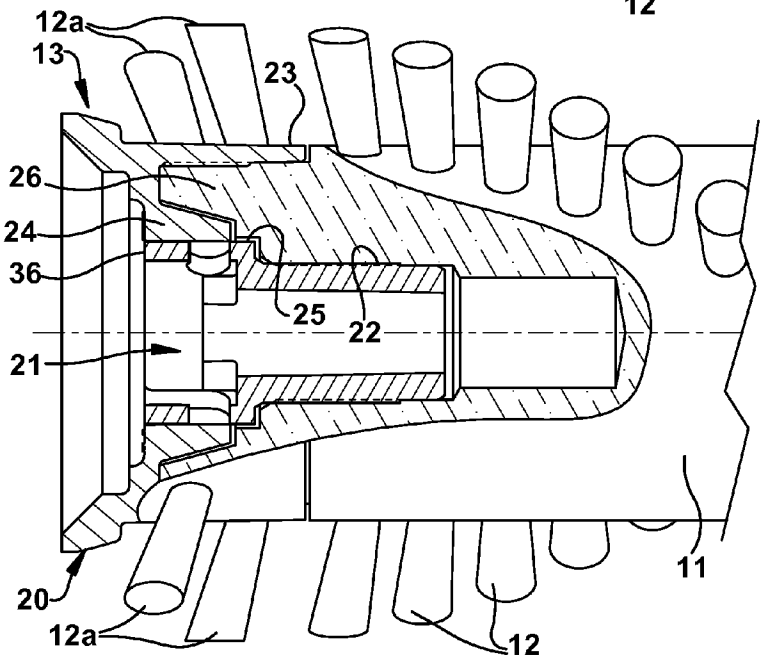
FIG. 2 is a fragmentary view in section showing the new spindle drive.
Figure 4:
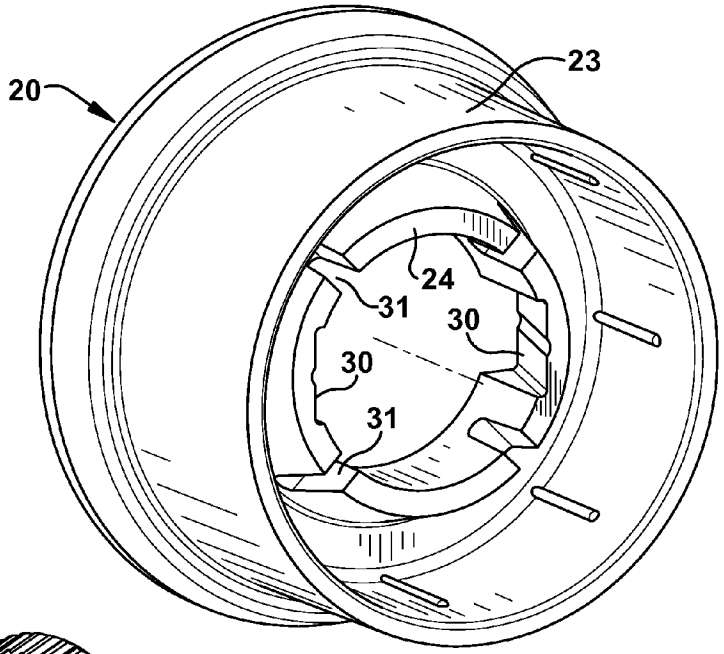
FIG. 4 is a perspective showing the other end of the ferrule.
Figure 3:
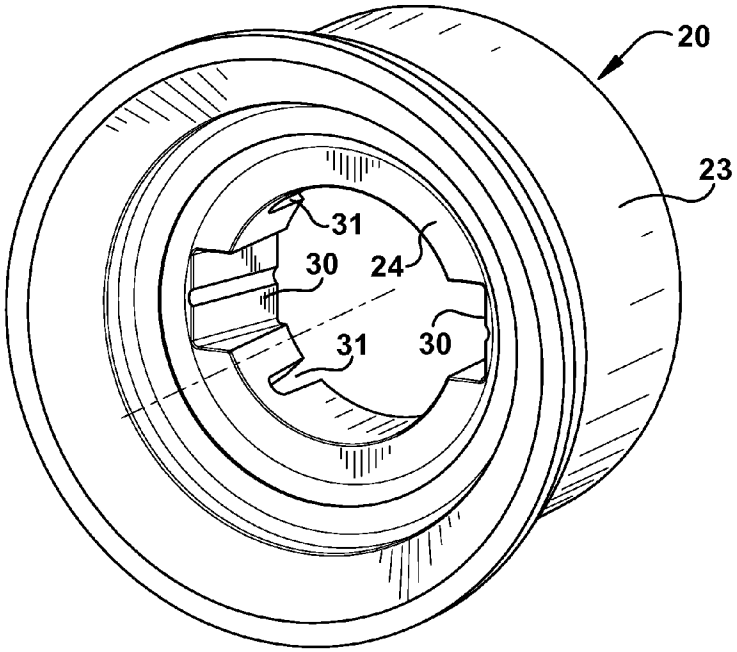
FIG. 3 is a perspective view showing one end of the ferrule.

As shown in FIGS. 2-4 the drive assembly 13 comprises a ferrule 20 attached to the end of the spindle 11 and a drive pin 21 inserted through the ferrule into a hole 22 drilled in the end of the spindle. The ferrule 20 has a skirt 23 that is press fitted around the end of the spindle 11 and a concentric inner neck 24 seated in a recess 25 in the end of the spindle. The recess 25 forms an opening to the hole 22 and is bounded by a lip 26 at the end of the spindle. The lip 26 is captured between the skirt 23 and the neck 24. The ferrule 20 also has diametrically opposed cam surfaces 30 on the inside of the ferrule neck 24. The cam surfaces extend axially radially inwardly of the ferrule. Slots 31 in the ferrule neck 24 between the cam surfaces 30 permit the neck to be forced open by insertion of the drive pin 21. In the preferred embodiment, bristle tufts 12*a* extend through the ferrule skirt 23 to assist in locking the ferrule to the spindle 11.

Figure 5:
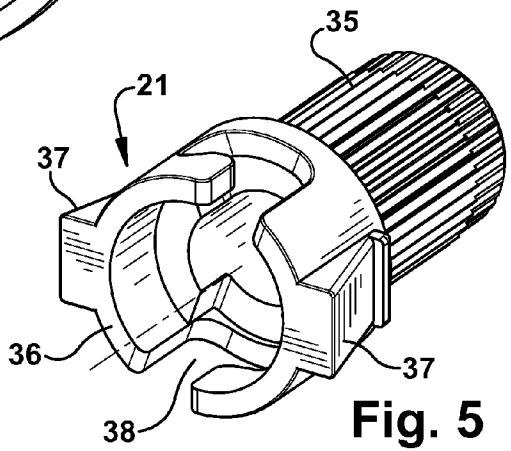
FIG. 5 is a perspective view of the drive pin.

The drive pin 21, which is shown most clearly in FIG. 5, has a knurled shaft end 35 that is pressed in the spindle hole 22 and a head 36 that is seated in the mouth of the ferrule 20. The head 36 has cam surfaces 37 and a bayonet slot 38. The cam surfaces 37 correspond to and engage the cam surfaces 30 of the ferrule 20 to lock the drive pin 21 and ferrule together, whereby torque can be transmitted through the drive pin to rotate the brushroll spindle 11. They bayonet slot 38 provides a quick connect-disconnect for the brushroll. The slot 38 receives a pin (not shown) carried by a shaft (also not shown) of the vacuum cleaner motor drive system and locks the pin when it is in the bottom of the slot. The brushroll can be removed or replaced by turning the brushroll to a position in which the shaft pin is engaged or disengaged from the slot 38.

The effective transmission of torque to rotate the brushroll is accomplished by combination of the above-described features of construction, namely, the skirted ferrule 20 that fits around the end of the spindle to capture the spindle end between the skirt and the spindle neck, and the cam surfaces

30, 37 that effectively lock the drive pin 21 in the ferrule. The two-piece construction of the ferrule and the drive pin 21 can be fitted in the end of a wood spindle, as distinguished from the prior art assembly involving a one-piece drive element that coacts with ribs on the inside of a plastic spindle. At the same time, the ferrule and drive pin can be separately made without the complex die construction required to make the plastic one-piece drive element of the prior art.

Other features and advantages of the invention will be apparent to those skilled in the art. Therefore, it is to be understood that, within the scope of the appended claims, the invention can be practiced otherwise than as specifically shown and described.

The invention claimed is:

1. A shaft driven brushroll that mounts in a vacuum cleaner and is rotated by direct connection to a shaft of the motor drive shaft system of said vacuum cleaner, said brushroll comprising:

(a) a spindle, (b) a ferrule at one end of said spindle, said ferrule having a skirt around said spindle and a portion seated in said one end, whereby said spindle is captured between said skirt and said ferrule portion, (c) a drive pin inserted through said ferrule into said one end of said spindle, said drive pin having a slot forming a quick connect-disconnect for locking said drive pin to a driver shaft of the motor drive shaft system of said vacuum cleaner, (d) said ferrule and said drive pin have coacting surfaces that lock the two members together, whereby torque is transmitted through said drive pin to rotate said spindle, and (e) bristle tufts projecting out from said spindle with some of said tufts extending through said ferrule skirt.

2. A shaft driven brushroll that can be mounted in the nozzle of a vacuum cleaner nozzle and connected directly to the vacuum cleaner motor drive shaft system, said brushroll comprising:

(a) a spindle having a hole drilled in one end and a recess forming an end opening for said hole, (b) a ferrule having a skirt embracing said end of said spindle, a neck seated in said recess to capture said spindle end between said skirt and said neck, and cam surfaces on the inside of said neck extending axially radially inwardly of said neck, (c) a drive pin having a shaft end pressed through said ferrule into said hole, and a head having cam surfaces engaging said cam surfaces of said neck, and a bayonet slot for receiving a shaft pin of said vacuum cleaner motor drive shaft system, (d) bristle tufts extending from said spindle with some of said tufts projecting through said skirt, and (e) a bearing end assembly at the other end of said spindle.

3. A brushroll as claimed in claim 2 wherein said spindle is wood.

* * * * *